US008292637B2

(12) United States Patent
Wu

(10) Patent No.: US 8,292,637 B2
(45) Date of Patent: Oct. 23, 2012

(54) ELECTRICAL CONNECTOR ASSEMBLY WTH HIGH-DENSITY CONFIGURATION

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/105,937

(22) Filed: May 12, 2011

(65) Prior Publication Data

US 2011/0281455 A1 Nov. 17, 2011

(30) Foreign Application Priority Data

May 12, 2010 (CN) ..... 2010 2 0187530

(51) Int. Cl.
*H01R 12/00* (2006.01)

(52) U.S. Cl. ..... 439/76.1; 439/607.55

(58) Field of Classification Search ..... 439/76.1, 439/76.2, 357, 358, 493, 625, 626, 607.55, 439/607.56
See application file for complete search history.

(56) References Cited

U.S. PATENT DOCUMENTS

| | | | | |
|---|---|---|---|---|
| 4,611,887 | A * | 9/1986 | Glover et al. | 385/71 |
| 7,160,135 | B1 * | 1/2007 | Wu | 439/352 |
| 7,303,438 | B2 | 12/2007 | Dawiedczyk et al. | |
| 7,318,740 | B1 * | 1/2008 | Henry et al. | 439/352 |
| 7,581,978 | B1 | 9/2009 | Briant | |

* cited by examiner

*Primary Examiner* — Khiem Nguyen
(74) *Attorney, Agent, or Firm* — Wei Te Chung; Ming Chieh Chang

(57) ABSTRACT

An electrical connector assembly (100), comprises: a housing (1) having therein a receiving room (11) communicating with an exterior along a longitudinal direction, and the housing comprising a first shield part (15) and second shield part (16) assembled with each other; two paralleled printed circuit boards (2) received into the receiving room and positioned in the housing; a strain relief (5) disposed between the first shield part and the second shield part along a vertical direction; a metallic holder (8) enclosing and engaged with the first shield part, the second shield part and the strain relief; and a latch mechanism assembled to an exterior surface of the housing and having a portion shielded by the metallic holder.

20 Claims, 14 Drawing Sheets

ELECTRICAL CONNECTOR ASSEMBLY WTH HIGH-DENSITY CONFIGURATION

FIELD OF THE INVENTION

The present invention generally relates to connectors suitable for transmitting data, more specifically to input/output (I/O) connectors with high-density configuration and high data transmitting rate.

DESCRIPTION OF PRIOR ART

One aspect that has been relatively constant in recent communication development is a desire to increase performance. Similarly, there has been constant desire to make things more compact (e.g., to increase density). For I/O connectors using in data communication, these desires create somewhat of a problem. Using higher frequencies (which are helpful to increase data rates) requires good electrical separation between signal terminals in a connector (so as to minimize cross-talk, for example). Making the connector smaller (e.g., making the terminal arrangement more dense), however, brings the terminals closer together and tends to decrease the electrical separation, which may lead to signal degradation.

In addition to the desire at increasing performance, there is also a desire to improve manufacturing. For example, as signaling frequencies increase, the tolerance of the locations of terminals, as well as their physical characteristics, become more important. Therefore, improvements to a connector design that would facilitate manufacturing while still providing a dense, high-performance connector would be appreciated.

Additionally, there is a desire to increase the density of I/O plug-style connectors and this is difficult to do without increasing the width of the connectors. Increasing the width of the plug connectors leads to difficulty in fitting the plug into standard width routers and/or servers, and would require a user to purchase non-standard equipment to accommodate the wider plug converters. As with any connector, it is desirable to provide a reliable latching mechanism to latch the plug connector to an external housing to maintain the mated plug and receptacle connectors together modifying the size and/or configuration the connector housing may result in a poor support for a latching mechanism. Latching mechanisms need to be supported reliably on connector housings in order to effect multiple mating cycles. Accordingly, certain individuals would appreciate a higher density connector that does not have increased width dimensions and which has a reliable latching mechanism associated therewith.

As discussed above, an improved electrical connector overcoming the shortages of existing technology is needed.

SUMMARY OF THE INVENTION

Accordingly, an object of the present invention is to provide an electrical connector assembly with high-density configuration and high data transmitting rate.

In order to achieve the above-mentioned objects, an electrical connector assembly, comprises a housing having a receiving room therein communicated with an exterior along a longitudinal direction, and the housing comprising a first shield part and second shield part assembled with each other; two paralleled printed circuit boards received into the receiving room and positioned in the housing; a metallic holder binding the first and second shield parts; and a latch mechanism assembled to an exterior surface of the housing and having a portion shielded by the metallic holder.

Other objects, features and advantages of the invention will be apparent from the following detailed description taken in connection with the accompanying drawings.

DETAILED DESCRIPTION OF PREFERRED EMBODIMENTS

Figure 1:
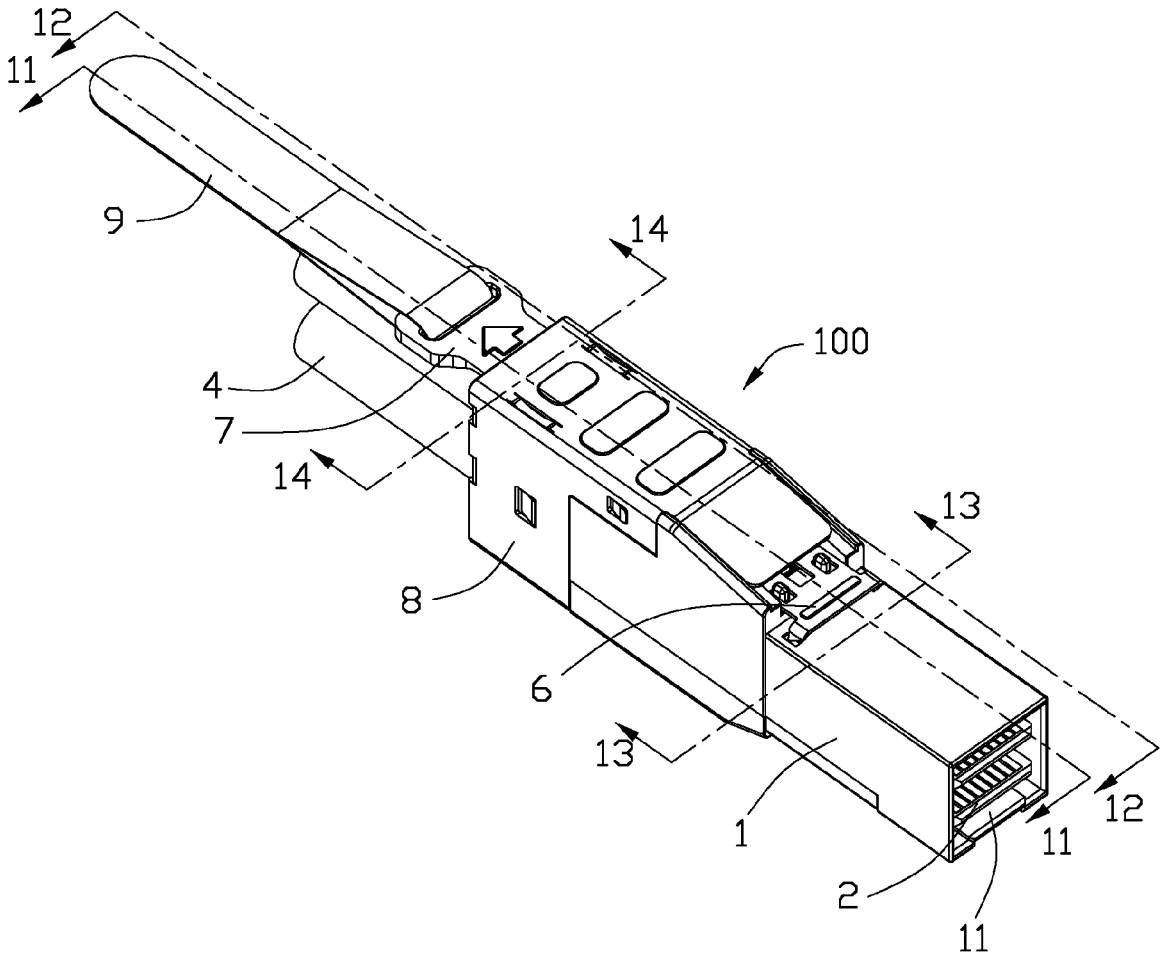
FIG. 1 is a perspective view of an electrical connector assembly in accordance with the present invention.
Figure 2:
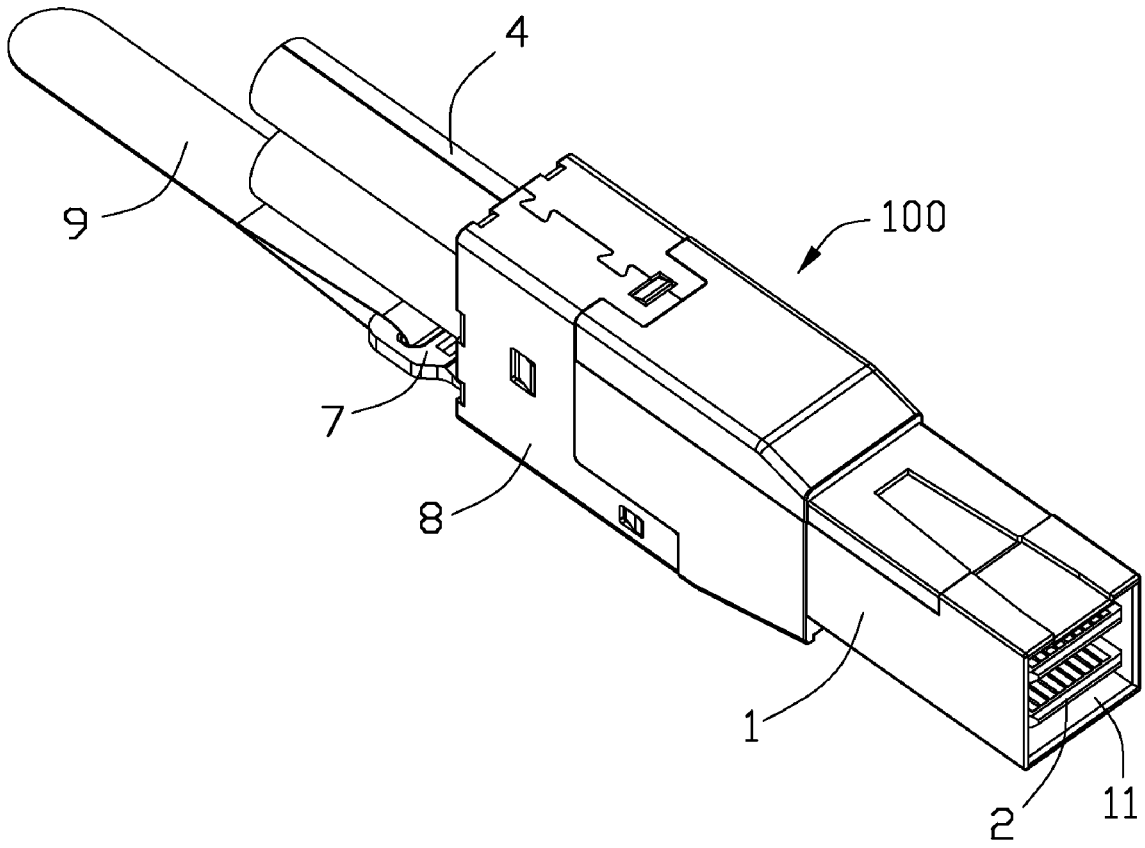
FIG. 2 is another perspective view of the electrical connector assembly of FIG. 1.
Figure 3:
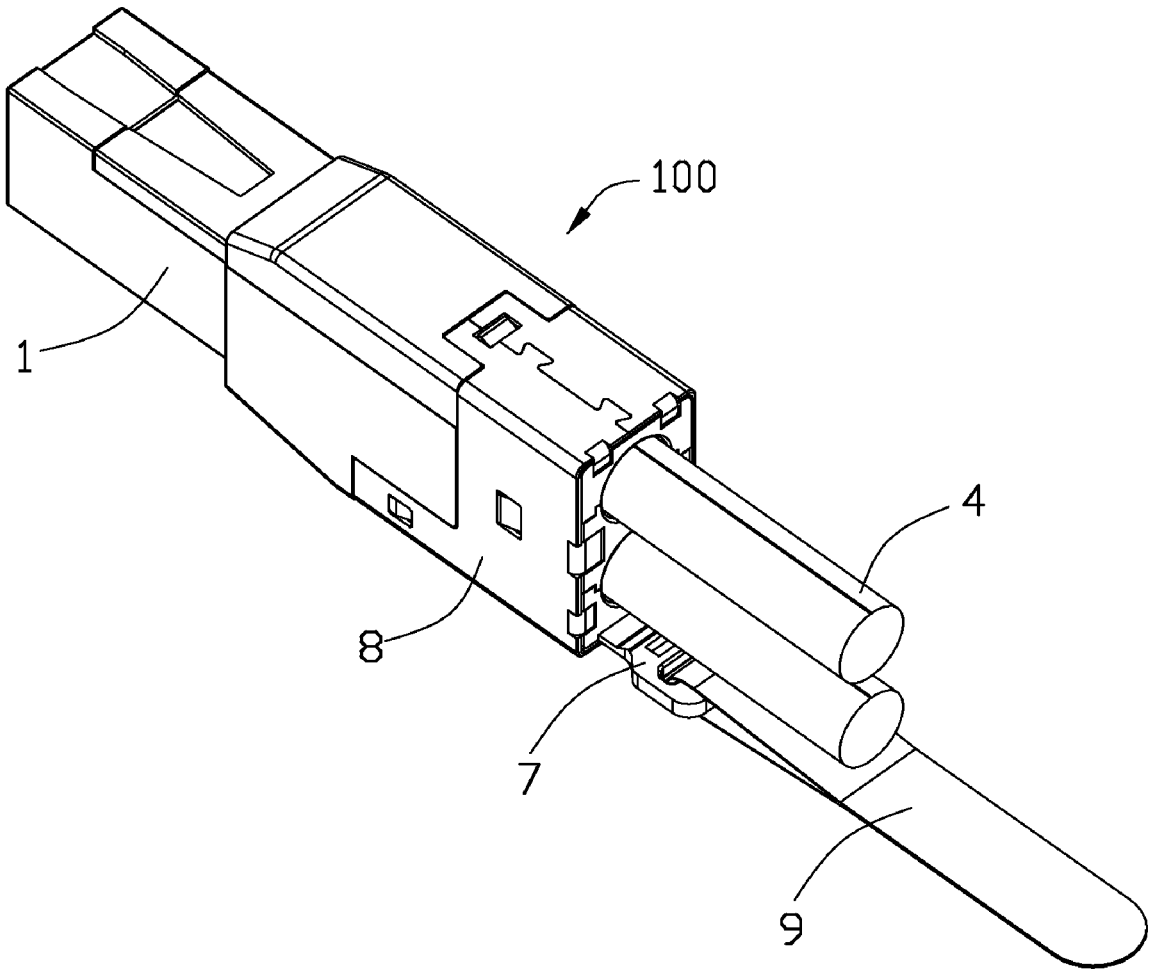
FIG. 3 is another perspective view of the electrical connector assembly of FIG. 2.

Reference will now be made to the drawing figures to describe the present invention in detail.

FIGS. 1 to 4 illustrate perspective views of an electrical connector assembly 100 made in accordance with the present invention. And in conjunction with FIGS. 7 to 12, the electrical connector assembly 100 comprises a housing 1 having a receiving room 11 therein, two paralleled printed circuit boards (PCBs) 2 disposed in the receiving room 11, a spacer 3 disposed between the two printed circuits boards 2 and positioned with the housing 1, two cables 4 respectively electrically connected with a printed circuit board 2 and a spacer or strain relief 5 disposed in the housing 1 and spaced apart with the two cables 4. The strain relief 5 has two side surfaces respectively in alignment with two side surfaces of the housing 1. The electrical connector assembly 100 further comprises a latch mechanism assembled to a top surface of the housing 1 and a metallic holder 8 surrounding a portion of the housing 1 and the latch mechanism. The latch mechanism comprises a latching member 6 and a pulling member 7 interconnected with each other.

Referring to FIGS. 1 and 4 to 10, the housing 1 is made of metallic material and formed in a die-cast manner. The housing 1 defines a body portion 12 and a mating portion 13 extending forward from the body portion 12 for mating to a complementary connector (not shown). The body portion 12 has a cross section larger than that of mating portion 13. The housing 1 defines a receiving room 11 extending rearward from a front surface to a rear surface thereof. The body portion 12 of the housing 1 has a top surface defined as a first surface 121, the mating portion 13 of the housing 1 has a top surface defined as a second surface 131. The first surface 121 is disposed above the second surface 131. And, the first surface 121 defines an inclined surface 1211 extending toward to the second surface 131. The body portion 12 defines a receiving cavity 14 extending downwardly from the inclined surface 1211 for a distance. The receiving cavity 14 has a bottom surface 141 located on a same level with the second face 131. And, the bottom surface 141 is defined as a third surface. A prominence 142 is formed in a front edge of the receiving cavity 14. Thus, the second surface 131 is separated to the third surface 131 along a front to rear direction. And, the prominence 142 further defines a pair of protrusions 142 formed on a top surface thereof. In addition, a pair of supporting portions 143 are formed on two inner side surfaces of the receiving cavity 14 for supporting a front curving portion 72 of the pulling member 7. Each supporting portions 143 has a front arc top surface and a rear inclined top surface. A slit 144 is formed in back of the receiving cavity 14 and communicated with the receiving cavity 14.

Referring to FIGS. 4 to 10, the housing 1 comprises a box-shape first shield part 15 and a second shield part 16 assembled with each other. The first shield part 15 defines a rectangular frame 151 formed at a front end thereof and defined as a mating port of the housing 1. The first shield part 15 further defines an opening 152 formed at a bottom end thereof. The opening 152 of the first shield part 15 will be shielded when the second shield part 16 is assembled to the first shield part 15. The first shield part 15 defines two first positioning posts 153 formed on an inner side surface thereof and another two first positioning posts 153 formed on another inner side surface thereof. Each two first positioning posts 153 are spaced apart with each other along a front-to-rear direction. Each first positioning post 153 has a semi-circular cross section. The first positioning posts 153 are used for supporting the printed circuit board 2 along an up-to-down direction. In addition, two second positioning posts 154 are respectively formed on two inner side surface of the first shield part 15. Each second positioning post 154 is disposed between the two first positioning posts 154 along a front-to-rear direction and used for limiting a movement of the printed circuit board 2 along a front to rear direction. Each second positioning post 154 also has a semi-circular cross section. And, the second positioning post 154 is longer than the first positioning post 153 along an up-to-down direction. The first shield part 15 defines a pair of wedge-shaped projections 155 formed on two side surfaces thereof. The second shield part 16 also defines a pair of wedge-shaped projections 161 formed on a bottom surface thereof. And, the first shield part 15 defines a pair of recesses 156 formed on a rear surface thereof. The second shield part 16 also defines a pair of recesses 162 formed on a rear surface thereof.

Figure 13:
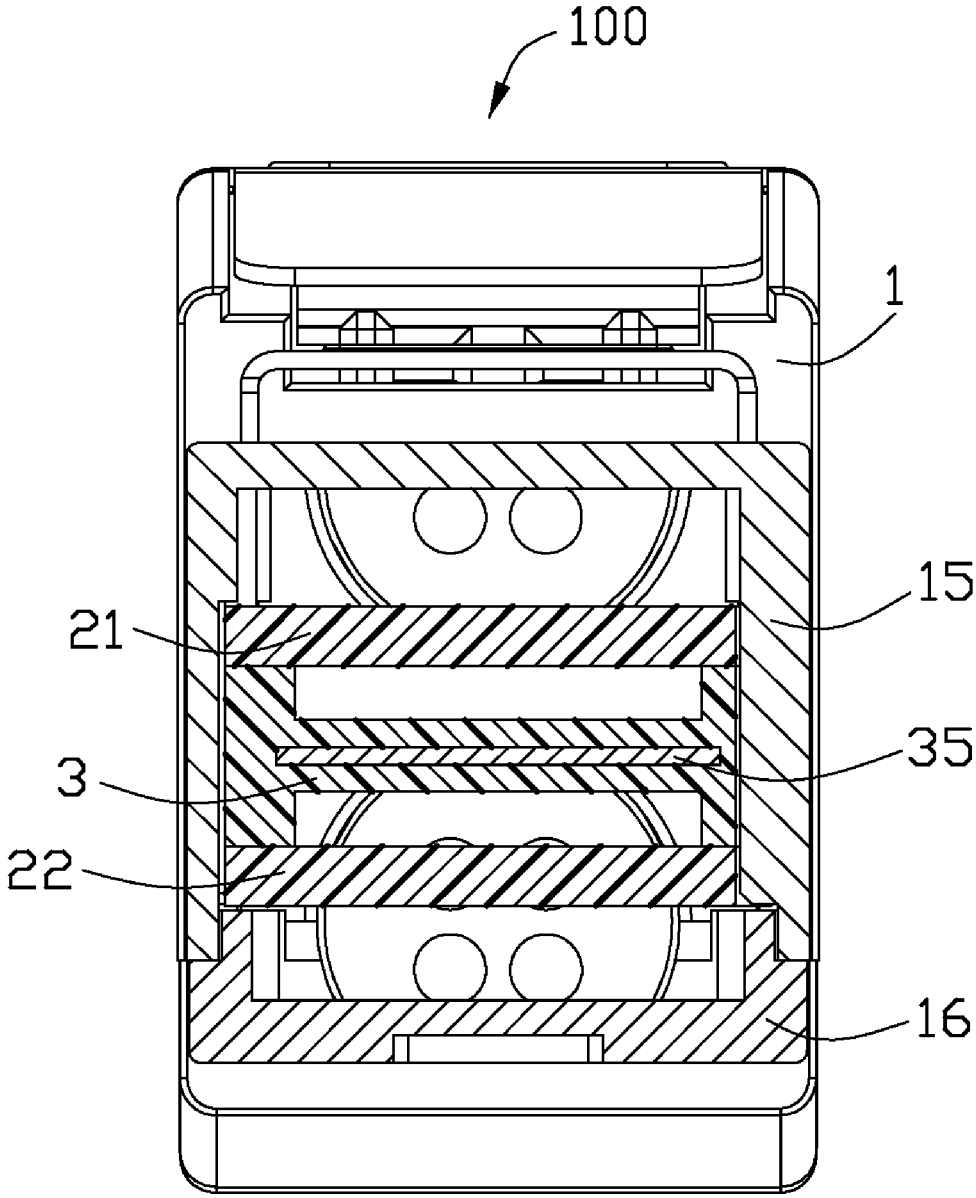
FIG. 13 is a cross section view of the electrical connector assembly of FIG. 1 taken along line 13-13.
Figure 14:
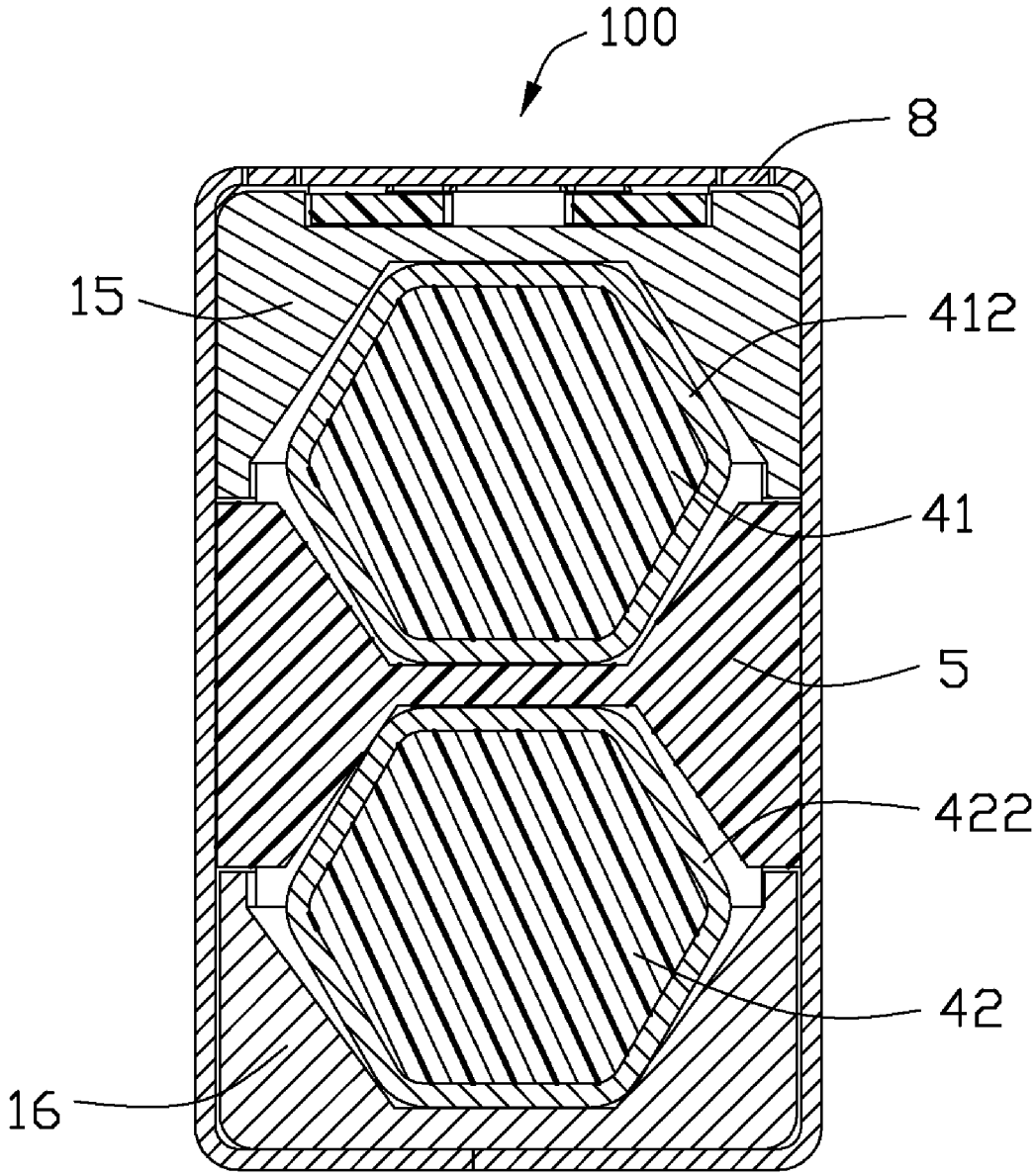
FIG. 14 is a cross section view of the electrical connector assembly of FIG. 1 taken along line 14-14.

Referring to FIGS. 7 to 11 and in conjunction with FIG. 13, two printed circuits 2 includes a first PCB 21 and a second PCB 22 respectively located on an upper side and a lower side of the receiving room 11 of the insulative housing 1. The first PCB 21 defines a first mating section 211 formed at a front end thereof and a first terminating section 212 formed at a rear end thereof. The second PCB 22 defines a second mating section 221 formed at a front end thereof and a second terminating section 222 formed at a rear end thereof. The first PCB 21 further defines a pair of first semi-circular cutouts 213 formed at two sides thereof. The second PCB 22 further defines a pair of second semi-circular cutouts 223 formed at two sides thereof. The first and second cutouts 213, 223 are used for cooperating with the two second positioning post 154 of the first shield part 15. A plurality of front conductive contacts (not figured) are formed on the first and second mating sections 211, 221. A plurality of rear conductive contacts (not figured) are formed on the first and second terminating sections 212, 222.

Figure 7:
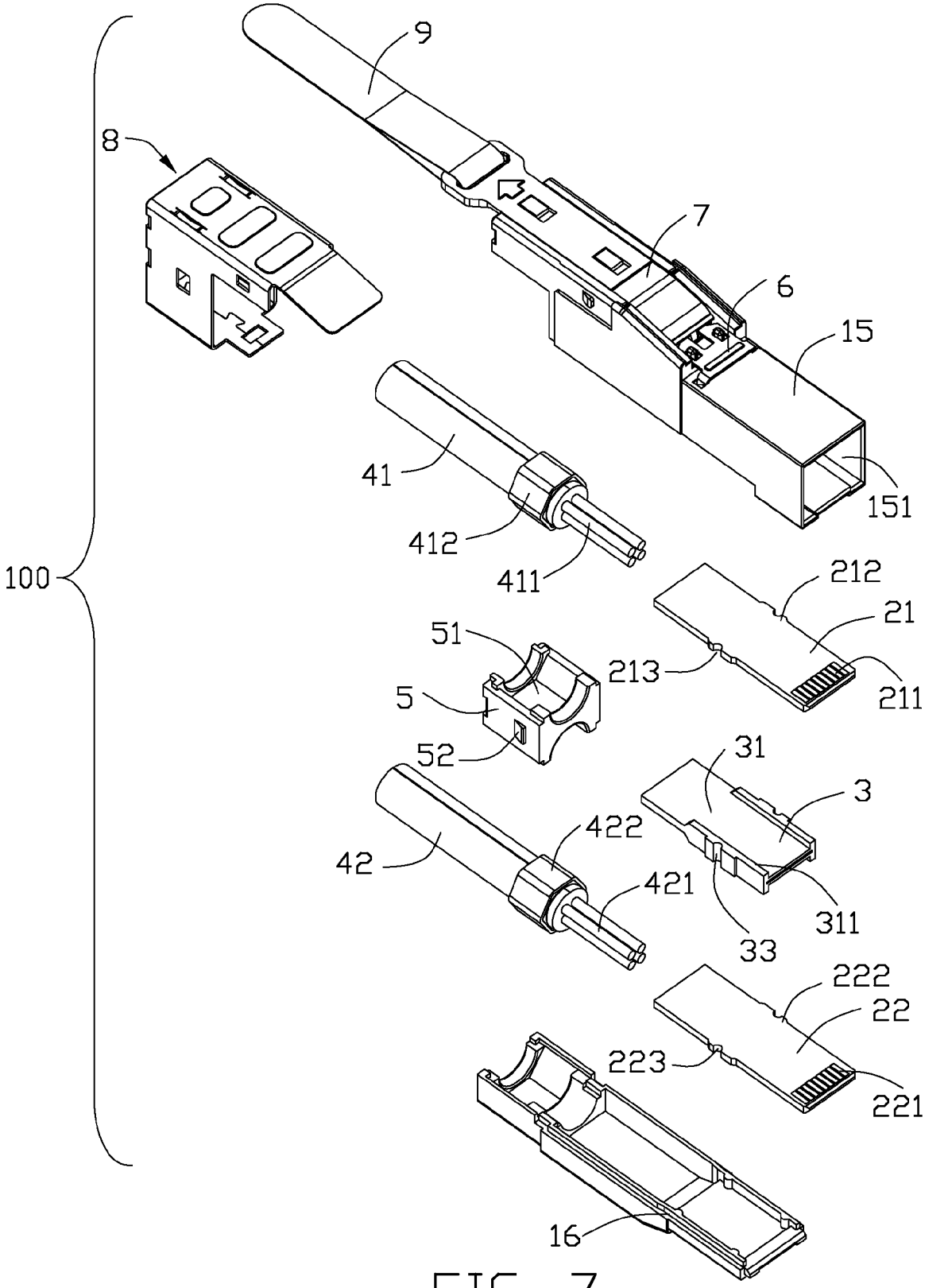
FIG. 7 is a partial assembled view of the electrical connector assembly of FIG. 1.
Figure 8:
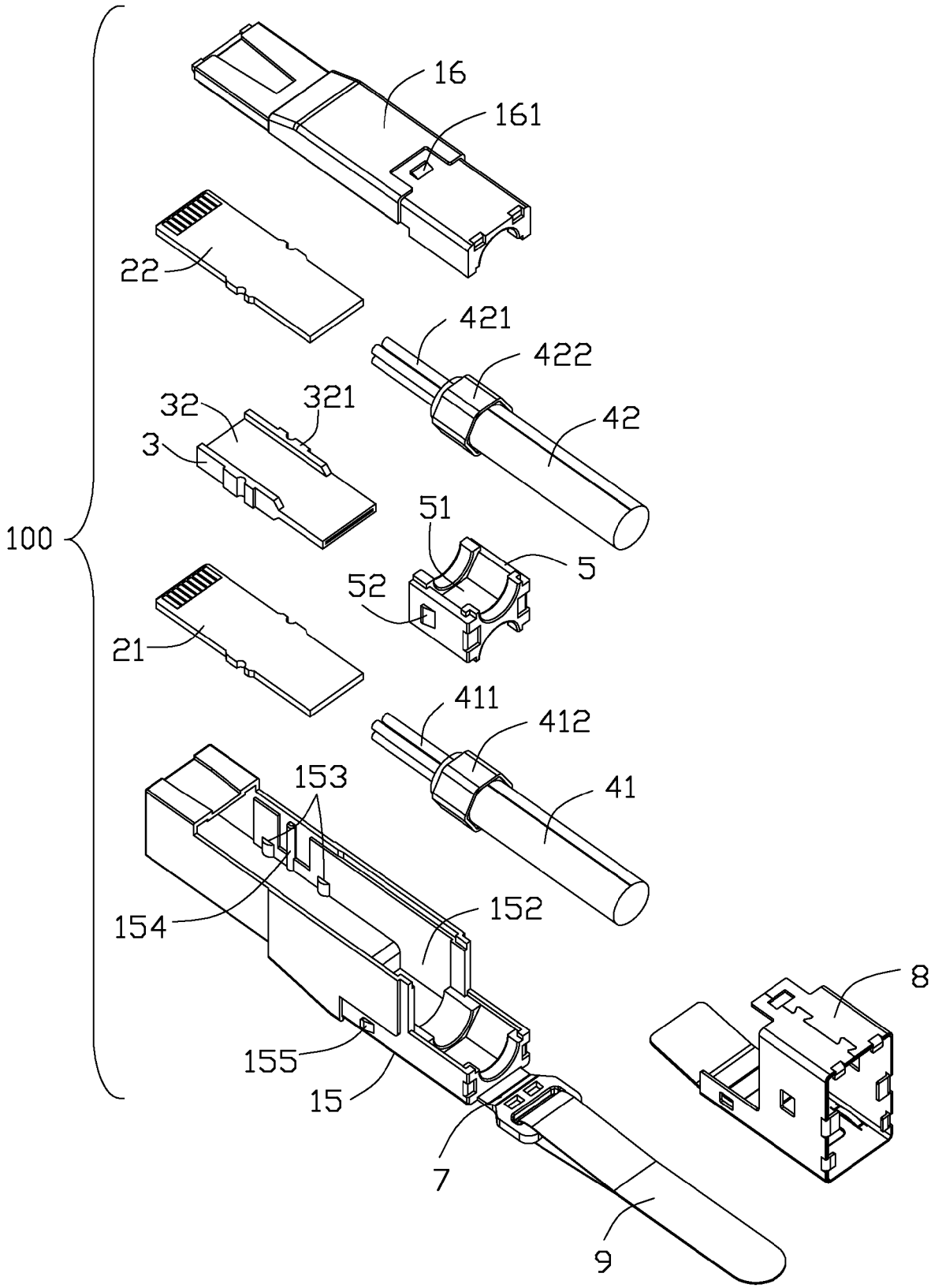
FIG. 8 is another partial assembled view of the electrical connector assembly of FIG. 7.
Figure 11:
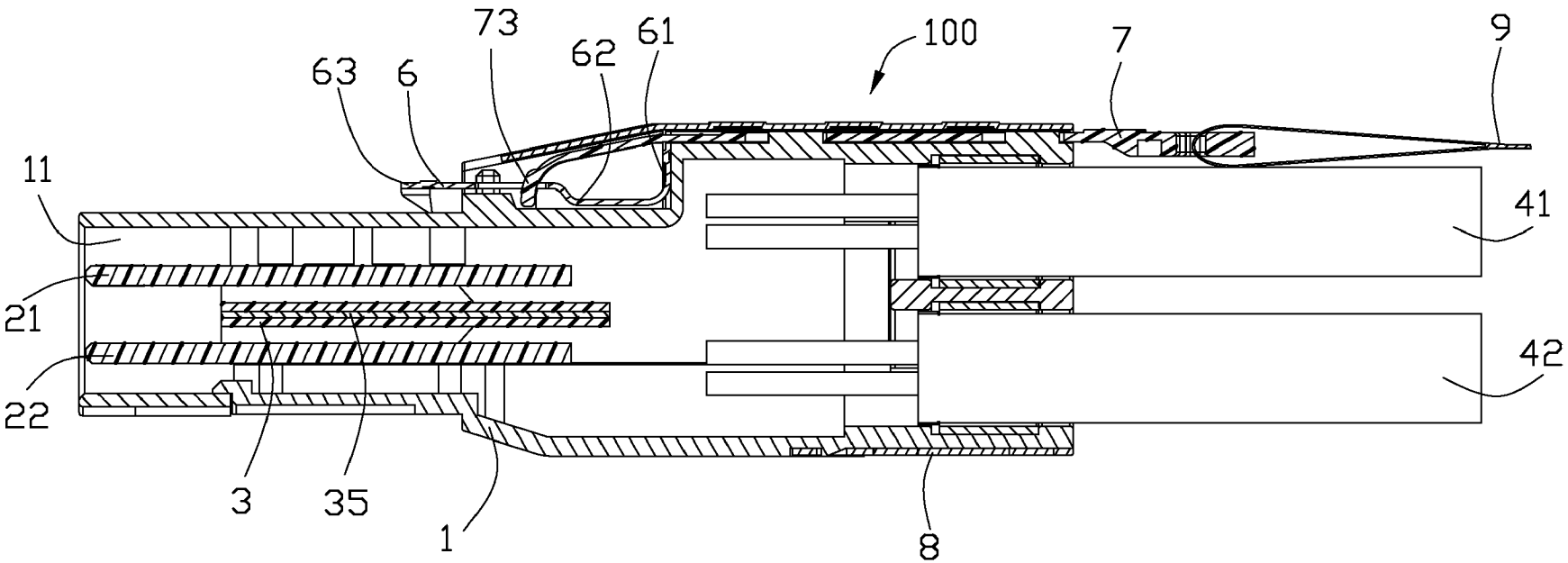
FIG. 11 is a cross section view of the electrical connector assembly of FIG. 1 taken along line 11-11.
Figure 12:
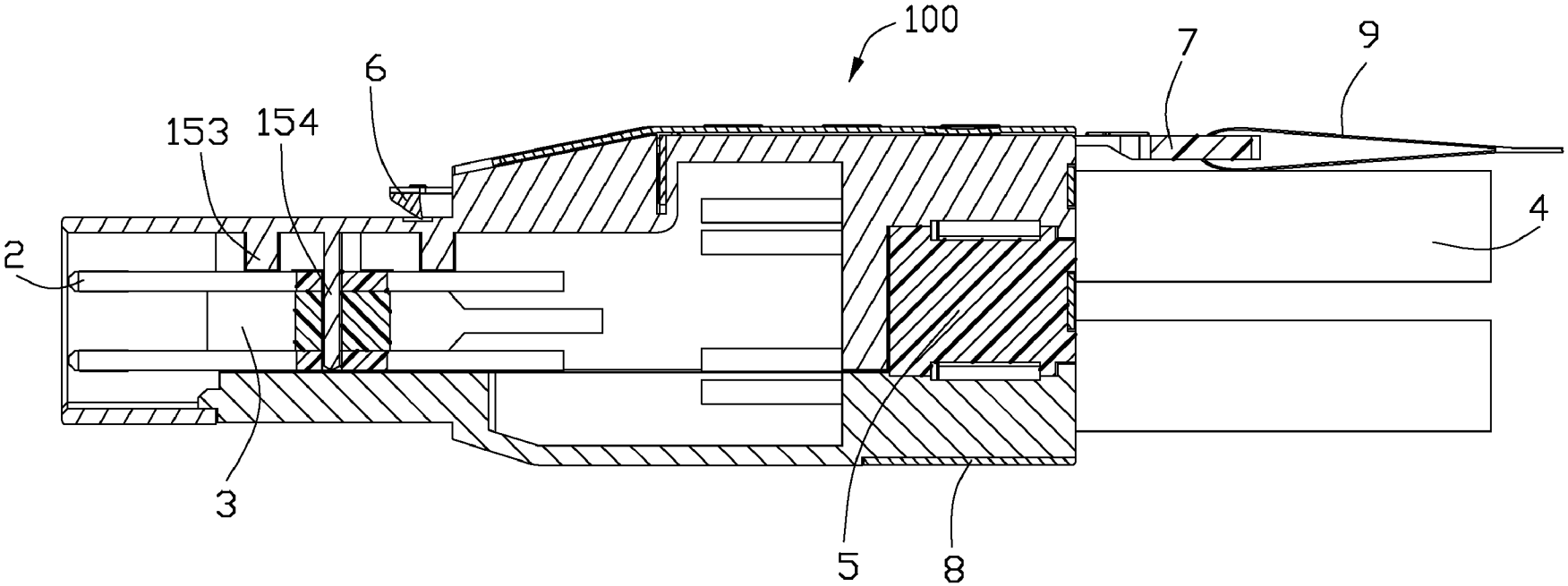
FIG. 12 is a cross section view of the electrical connector assembly of FIG. 1 taken along line 12-12.

Referring to FIGS. 7 to 8 and in conjunction with FIGS. 11 to 13, a spacer 3 is formed of insulative material and defines an upper surface 31 and a lower surface 32. The spacer 3 defines a pair of ribs 311 respectively formed at two sides of the upper surface 31 and another pair of ribs 312 respectively formed at two sides of the lower surface 32 for supporting the first and second PCBs 21, 22. The spacer 3 further defines a pair of grooves 33 respectively formed on two sides thereof and extending along a vertical direction for cooperating with the corresponding second positioning posts 154. The spacer 3 further defines a grounding plate 35 integrative formed therein. Thus, the grounding plate 35 is firmly positioned in the spacer 3.

Referring to FIGS. 6 to 8 and 14, two cables 4 comprises a first cable 41 and a second cable 42. The first cable 41 has a plurality of first conductors 411 therein electrically connected to a first terminating section 212 of the first PCB 21. The second cable 42 has a plurality of second conductors 421 electrically connected to a second terminating section 222 of the second PCB 22. A first ring 412 is disposed at a front end of the first cable 41 and surrounding a portion of the first cable 41. A second ring 422 is disposed at a front end of the second cable 42 and surrounding a portion of second cable 42.

Figure 6:
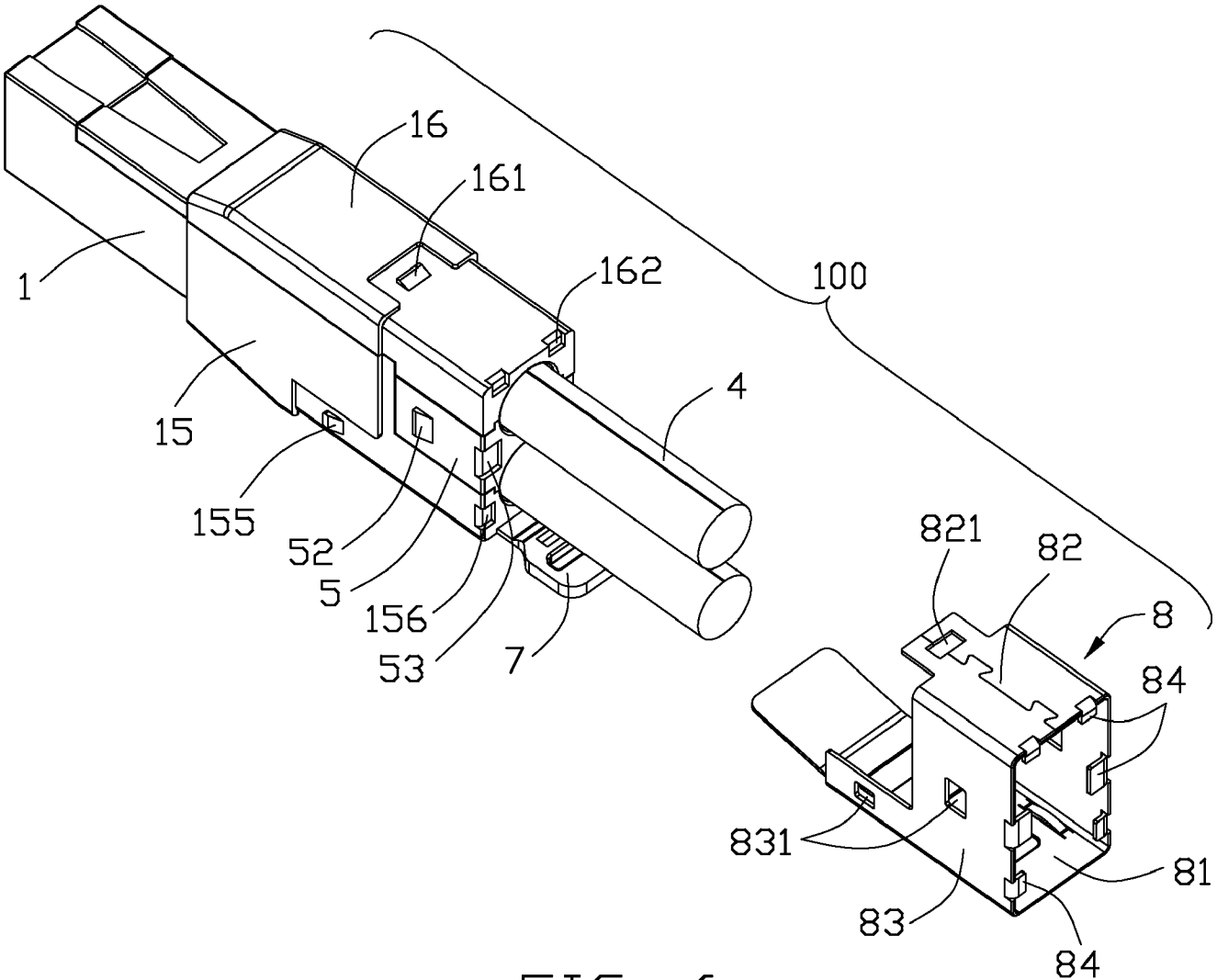
FIG. 6 is a partial exploded, perspective view of the electrical connector assembly of FIG. 3.

Referring to FIGS. 6 to 8, a strain relief 5 is made of metallic material and disposed into the housing 1. The strain relief 5 has two depressed sections 51 respectively formed on a top and bottom surfaces thereof for receiving a portion of the first and second rings 412, 422. The strain relief 5 defines a pair of wedge-shaped projections 52 formed on two side surfaces thereof. The strain relief 5 also defines a pair of recesses 53 formed on a rear surface thereof.

Figure 9:
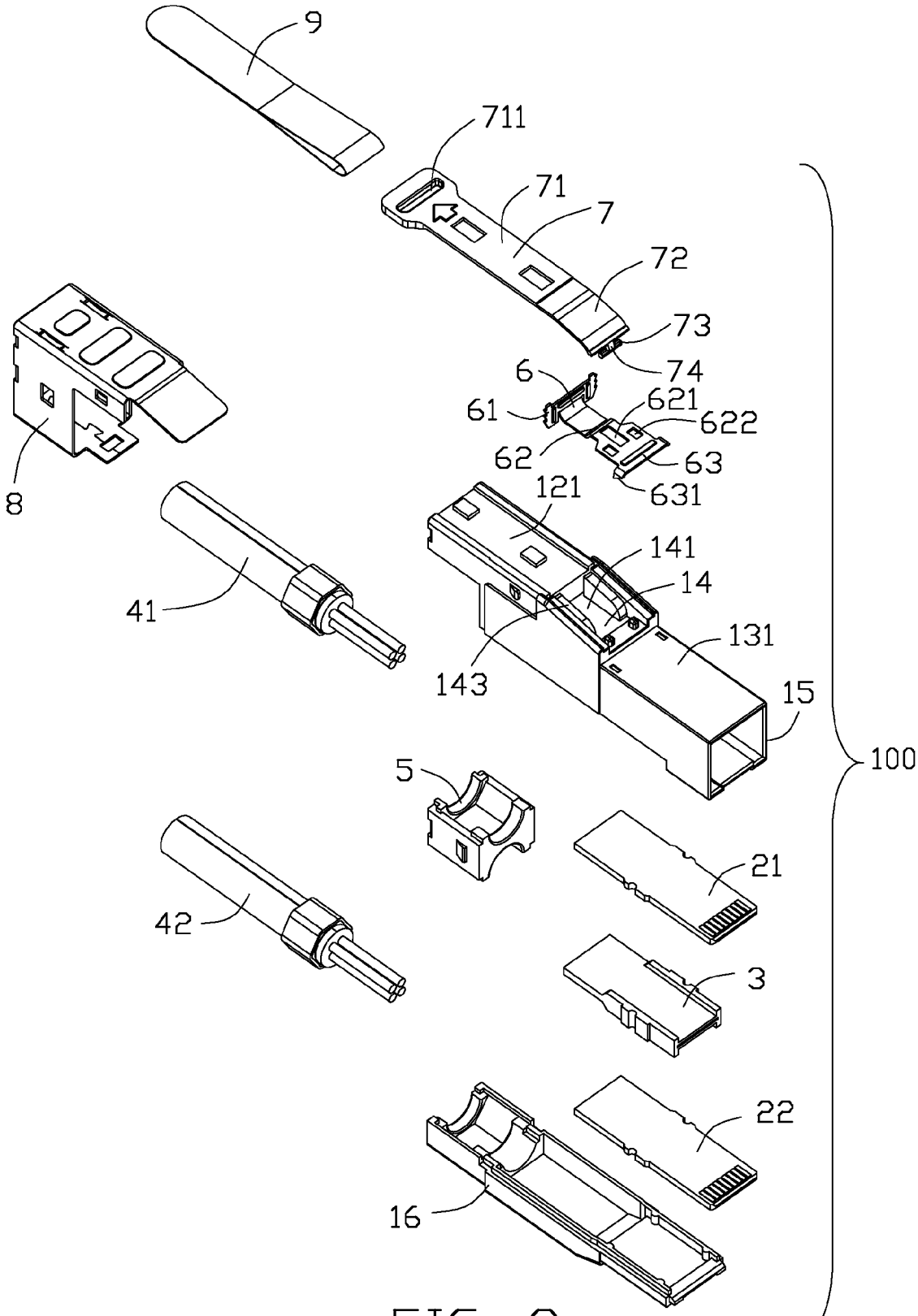
FIG. 9 is an exploded, perspective view of the electrical connector assembly of FIG. 1.
Figure 10:
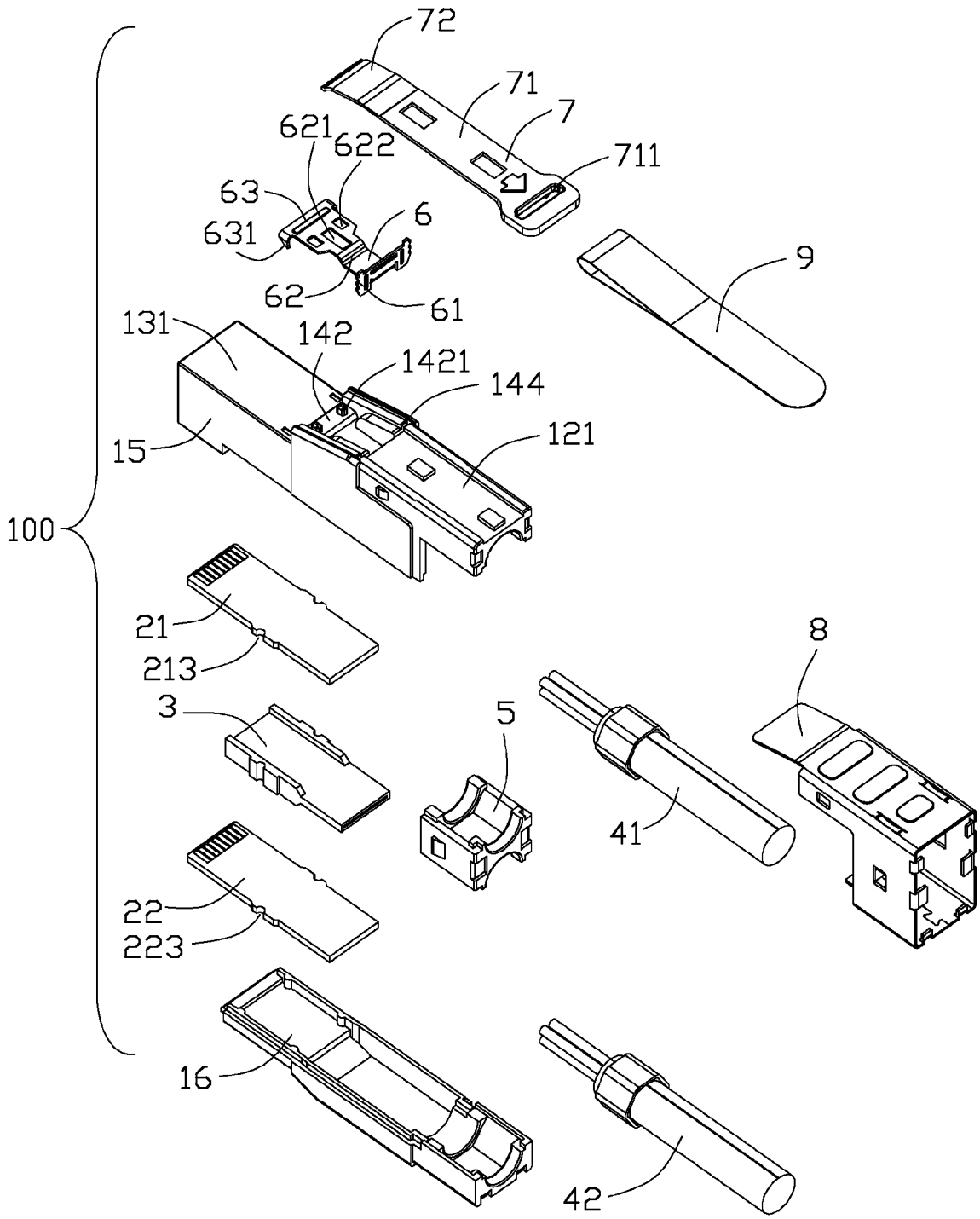
FIG. 10 is another exploded, perspective view of the electrical connector assembly of FIG. 9.

Referring to FIGS. 9 to 11, the latching member 6 is stamped and formed from a metallic plate and comprises a vertical retaining portion 61, a connecting portion 62 extending forwardly from a bottom side of the retaining portion 61 and a latching portion 63 extending forwardly from the connecting portion 62. A front portion of the latch 6 is defined as a latching portion 63. The retaining portion 61 defines a plurality of sharp projections 611 formed at two sides thereof. The connecting portion 62 defines a rectangular hole 621 and a pair of quadrate holes 622 disposed at two sides of the rectangular hole 621. The latching portion 63 defines a pair of barbs 631 formed at two sides thereof.

Referring to FIGS. 3 to 6 and in conjunction with FIG. 11, the pulling member 7 is made of insulative material and structured in a flat shape. The pulling member 7 defines a horizontal section 71 and a curving section 72 extending forwardly and downwardly from the horizontal section 71. The pulling member 7 defines an actuating section 73 formed at a front free end thereof and a connecting section 74 connecting the actuating section 73 to the curving section 72. The actuating section 73 is generally perpendicular to the connecting section 74. The actuating section 73 is generally in a shape of cylinder extending along a transversal direction. The pulling member 7 has a slit 711 formed a rear end thereof. A tape 9 is passed through the slit 711 and connected to the pulling member 7.

Figure 4:
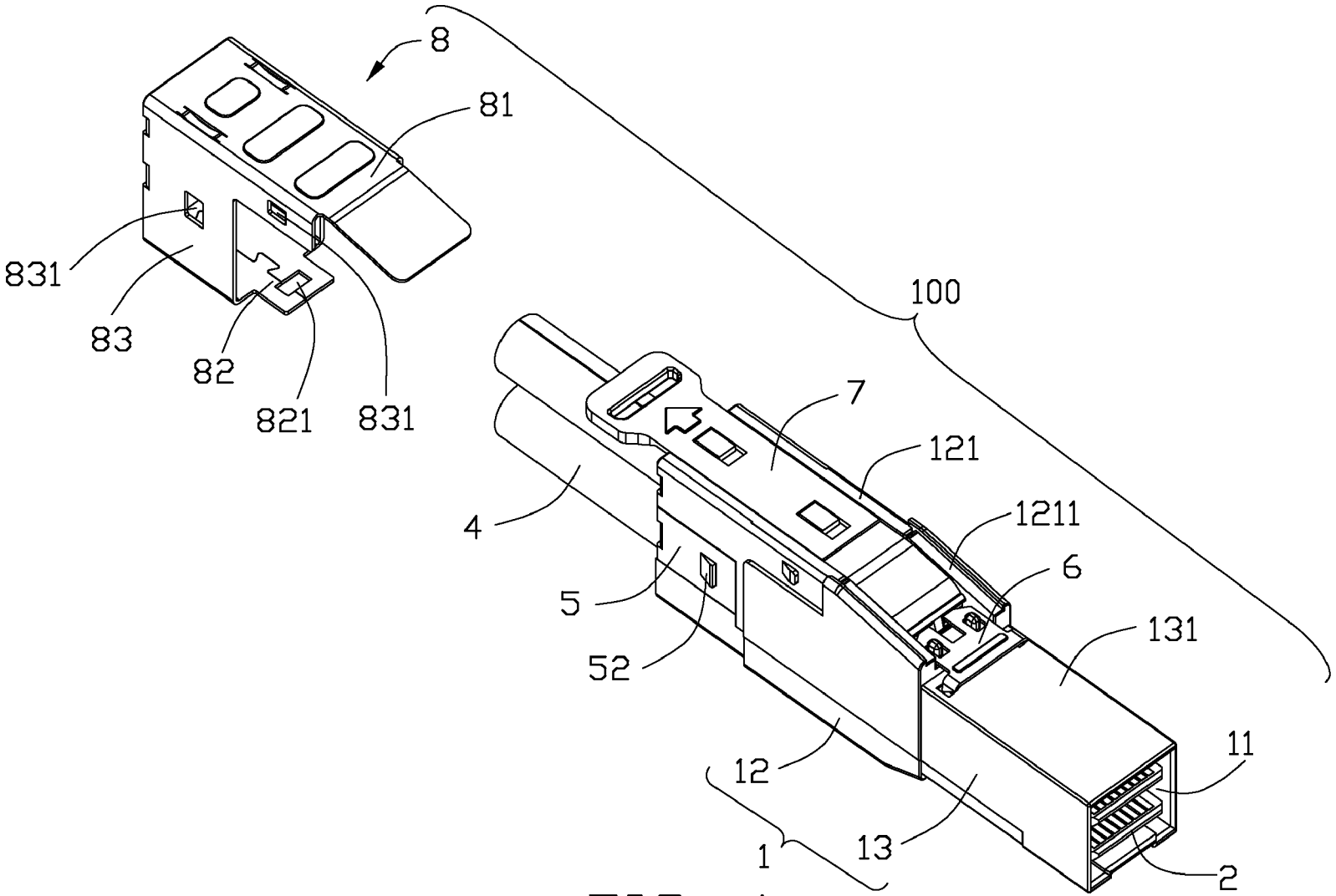
FIG. 4 is a partial exploded, perspective view of the electrical connector assembly of FIG. 1.
Figure 5:
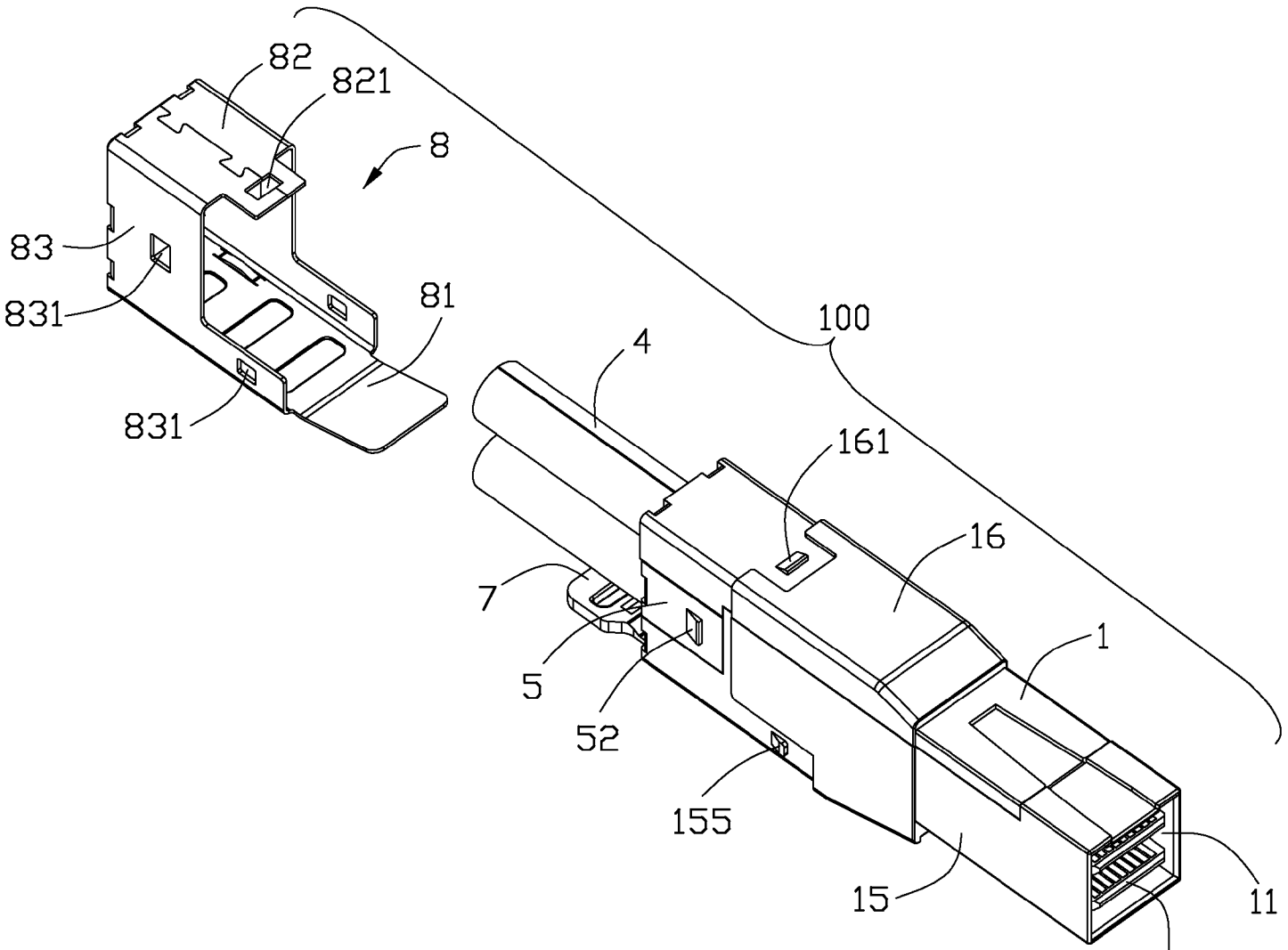
FIG. 5 is similar to FIG. 4, but viewed from another aspect.

Referring to FIGS. 4 to 6, the metallic holder 8 defines a top wall 81, a bottom wall 82 and a pair of side walls 83 respectively connected with the top wall 81 and the bottom wall 82. Each of side wall 82 of the metallic holder 8 defines two positioning holes 831 arranged along a front to rear direction. The bottom wall 82 also defines a positioning hole 821. One positioning hole 831 of the side wall 82 is engaged with the projection 155 of the first shield part 15. One positioning hole 831 of the side wall 82 is engaged with the projection 52 of the strain relief 5. And the positioning holes 831 is engaged with the projection 161 of the second shield part 16. The top wall 81 of the metallic holder 8 shields a portion of the latching member 6 and the pulling member 7. The metallic holder 8 defines a plurality of tabs 84 formed on two side walls 83 and a bottom wall 82 and received into the recesses 156, 162, 53 of the first and second shield parts 15, 16 and the strain relief 5.

Referring to FIGS. 1 to 14, the assembling process of the electrical connector assembly 100 made in according to the present invention starts from soldering the first and second conductors 411, 421 of the first and second cables 41, 42 respectively to the first and second terminating sections 212, 222 of the first and second PCBs 21, 22.

After the first cable 41 is assembled to the first PCB 21, then turning over the first shield part 15 to make the opening 152 facing upward and assembling the first PCB 21 to the first shield part 15 through the opening 152. The first PCB 21 is supported by the first positioning posts 153 formed in the passageway 155 of the shield part 15 along a vertical direction. The first PCB 21 is positioned with the shield part 15 along a front-to-rear direction due to two first cutouts 213 of the first PCB 21 cooperated with the pair of second positioning posts 154 of the shield part 15. And, a front end of the first cable 41 is supported by a rear end of the first shield part 15.

After the first cable 41 and the first PCB 21 are assembled to the first shield part 15, then assembling the strain relief 5 to a rear end of first shield part 15. And, the first ring 412 is received into a space between the first shield part 15 and the strain relief 5.

After the strain relief 5 is assembled to the first shield part 15, then assembling the spacer 3 to the first shield part 15. The spacer 3 is positioned with the first shield part 15 and located on the first PCB 21. The pair of second positioning posts 154 of the first shield part 15 pass through the corresponding two grooves 33 of the spacer 3 along an up-to-down direction to limit a movement of the spacer 3 along a front to rear direction.

After the spacer 3 is assembled to the first shield part 15, then assembling the second PCB 22 and the second cable 42 together to the first shield part 15 and located on the spacer 3. The second PCB 22 is positioned with the first shield part 15 along a front-to-rear direction due to two second cutouts 223 of the second PCB 22 cooperated with the pair of second positioning posts 154 of the shield part 15. And, a front end of the second cable 42 is supported by the strain relief 5. The second ring 422 of the second cable 42 has a half portion located in a depressed section 51 of the strain relief 5.

After the second PCB 22 and the second cable 42 are assembled to the first shield part 15, then assembling the second shield part 16 to the first shield part 15. Thus, the opening 152 of the first shield part 15 is shielded by second shield part 16 along an up-to-down direction. And, the first and second PCBs 21, 22 are received into the receiving room 11 of the housing 1. The first and second PCBs 21, 22 are also supported by the second shield part 16 along an up-to-down direction. And, the mating sections 211, 221 of the first and second PCBs 21, 22 are received into the mating port of the housing 1.

After the second shield part 16 is assembled to the first shield part 15, then assembling the latching member 6 to the pulling member 7 together through following steps. Firstly, the latching member 6 is disposed in front of pulling member 7 and arranged perpendicular to the pulling member 7. Secondly, the actuating section 73 of the pulling member 6 is passed through the rectangular hole 621 of the latching member 6 and located below the latching member 6. Thirdly, the latching member 6 is rotated 90 degree to make the latching member 6 and the pulling member 6 in line. Thus, the latching member 6 is interconnected with the pulling member 7. And, the latching 6 is not easily discrete from the pulling member 7 due to the width of the actuating section 73 is wider than that of the rectangular hole 621.

Then, assembling the latching member 6 and the pulling member 7 together to an exterior surface of housing 1. The horizontal section 71 of the pulling member 7 is located on the first surface 121 of the body portion 12 of the housing 1. The curving section 72 of the pulling member 7 is supported by the pair of supporting portions 143 formed in the receiving cavity 14. The rear end of the pulling member 7 extends rearwardly beyond the rear surface of the housing 1. In addition, the latching member 6 is received into the receiving cavity 14. Thus, the actuating section 73 of the pulling member 7 is disposed between the latching member 6 and the third surface 141 of the receiving cavity 14. Two sides of the retaining portion 61 of the latching member 6 are disposed into the slit 144 to make the latching member 6 engaged with the housing 1. The connecting portion 62 of the latching member 6 is located above the third surface 141. The latching portion 63 extends forwardly and is located above the second surface 131 of the mating portion 13 of the housing 1. The latching portion 63 is cantilevered from the retaining portion 61. A tape 9 is passed through the slit 711 and connected to the pulling member 7. When a rearward pulling force is exerted on a rear end of the pulling member 7 or the tape 9, the latching portion 63 of the latching member 6 will be raised up. When the rearward pulling force is released, the latching portion 63 of the latching member 6 will resume to an original state.

Finally, assembling the metallic holder 8 to the housing 1 along a rear-to-front direction. The first part 15, the second shield part 16 and the strain relief 5 are bound together by the metallic holder 8. The pulling member 7 is also shielded by the metallic holder 8. And, the pulling member 7 can be moved along a front to rear direction relative to the housing 1 and limited by the metallic holder 8 along a vertical direction. The metallic holder 8 is positioned with the housing 1 and the strain relief 5 through the projections 155, 52, 161 cooperated with the positioning holes 831, 821. And, a plurality of tabs 84 formed on the metallic holder 8 are received into the recesses 156, 162, 53 of the first and second shield parts 15, 16 and the strain relief 5.

After the above assembling steps, the entire process of assembling of the electrical connector assembly 100 is finished. The electrical connector assembly 100 has a new mating surface to meet higher and higher data transmitting rate. In addition, the electrical connector assembly 1 has a narrow profile and high-density configuration. Thus, the complementary connector (not shown) for mating with the electrical connector assembly 100 will also occupy little space to meet a miniaturization of an internal room of the communication device. On another aspect, a reliable latch mechanism is provided to an exterior surface of the housing. And, an easily and conveniently operating manner between the latching member 6 and the pulling member 7 is achieved.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

a housing having therein a receiving room communicating with an exterior along a longitudinal direction, and the housing comprising a first shield part and second shield part assembled with each other;

two paralleled printed circuit boards received into the receiving room and positioned in the housing;

a strain relief disposed between the first shield part and the second shield part along a vertical direction;

a metallic holder enclosing and engaged with the first shield part, the second shield part and the strain relief; and a latch mechanism assembled to an exterior surface of the housing and having a portion shielded by the metallic holder.

2. The electrical connector assembly as recited in claim 1, wherein the electrical connector assembly further comprises two cables extending into the receiving room and respectively electrically connected with two printed circuit boards.

3. The electrical connector assembly as recited in claim 1, wherein the electrical connector assembly further comprises a spacer disposed between the two printed circuit boards, and the spacer further defines a grounding plate integrative formed therein.

4. The electrical connector assembly as recited in claim 1, wherein the housing defines a mating port formed on front end of the first shield part, two mating portions of the two printed circuit boards are disposed in the mating port.

5. The electrical connector assembly as recited in claim 1, wherein the latch mechanism comprises a latching member and a pulling member interconnected with each other and respectively located on different surfaces of the housing, the pulling member is located on a higher surface, the latching member is located on a lower surface.

6. The electrical connector assembly as recited in claim 5, wherein the pulling member has a front end extending downwardly and passing through the latching member and located below the latching member.

7. The electrical connector assembly as recited in claim 6, wherein the latching member is operated in a lever manner when the pulling member is moveable in a horizontal direction.

8. The electrical connector assembly as recited in claim 1, wherein the metallic holder is formed by a top wall, a bottom wall and a pair of side walls connected with the top wall and the bottom wall.

9. The electrical connector assembly as recited in claim 1, wherein the metallic holder defines a plurality of positioning holes, the housing and the strain relief respectively defines a plurality of projections cooperated with the positioning holes.

10. The electrical connector assembly as recited in claim 1, wherein the metallic holder defines a plurality of tabs respectively received into a plurality of recesses form on a rear surface of the housing and the strain relief.

11. An electrical connector assembly, comprising:

a metallic housing having a mating port, the metallic housing having a first shield part and second shield part assembled with each other;

two paralleled printed circuit boards disposed in the metallic housing, two front mating sections of the two printed circuit boards received into the mating port;

a strain relief disposed in rear region of the housing and sandwiched by the first and second shield part;

a pair of cables extending into the housing and electrically connected with two printed circuit board and spaced apart by the strain relief along a vertical direction; and a metallic holder binding and engaged with the first shield part, the second shield part and the strain relief.

12. The electrical connector assembly as recited in claim 11, wherein the electrical connector assembly further defines a latching mechanism assembled to a top surface of the housing and enclosed by the metallic holder.

13. The electrical connector assembly as recited in claim 11, wherein mating port is formed on the first shield part.

14. The electrical connector assembly as recited in claim 11, wherein the housing defines a body portion and a mating portion extending forward from the body portion, the metallic holder is formed around the body portion.

15. The electrical connector assembly as recited in claim 11, wherein the metallic holder defines a plurality of positioning holes, the housing and the strain relief respectively defines a plurality of projections cooperated with the positioning holes.

16. The electrical connector assembly as recited in claim 11, wherein the metallic holder defines a plurality of tabs respectively received into a plurality of recesses formed on a rear surface of the housing and the strain relief.

17. An electrical connector assembly comprising:

a housing having a first shield part and a second shield part stacked with each other in a vertical direction and commonly defining a receiving space;

first and second printed circuit boards cooperating with each other to sandwich a spacer therebetween, and together with said spacer to be received in the receiving space;

a strain relief received located behind and in alignment with the spacer in a front-to-back direction perpendicular to said vertical direction; and first and second cables located behind and connected to and extending away from rear portion of the first and second printed circuit boards, respectively, in the front-to-back direction; wherein the spacer is enclosed in the housing while the strain relief is essentially sandwiched between the first and second shield parts in the vertical direction and exposed to an exterior.

18. The electrical connector assembly as claimed in claim 17, further including a metallic holder retained to all said first shield part, the second shield part and the strain relief.

19. The electrical connector assembly as claimed in claim 18, further including a latch mechanism sandwiched between the holder and the housing in the vertical direction.

20. The electrical connector assembly as claimed in claim 17, wherein the strain relief is sandwiched between the first and second cables.

* * * * *